US009617841B2

(12) United States Patent
Boedeker et al.

(10) Patent No.: US 9,617,841 B2
(45) Date of Patent: Apr. 11, 2017

(54) HYDRAULIC FRACTURING BALL SEALERS

(71) Applicants: Marvin Boedeker, Shiner, TX (US); Michael Raindl, Shiner, TX (US); Andrew Houbre, New Bedford, MA (US); Mark Brodeur, New Bedford, MA (US); Michael Vieira, New Bedford, MA (US)

(72) Inventors: Marvin Boedeker, Shiner, TX (US); Michael Raindl, Shiner, TX (US); Andrew Houbre, New Bedford, MA (US); Mark Brodeur, New Bedford, MA (US); Michael Vieira, New Bedford, MA (US)

( * ) Notice: Subject to any disclaimer, the term of this patent is extended or adjusted under 35 U.S.C. 154(b) by 0 days.

(21) Appl. No.: 14/290,936

(22) Filed: May 29, 2014

(65) Prior Publication Data

US 2015/0345247 A1 Dec. 3, 2015

(51) Int. Cl.
*E21B 43/26* (2006.01)
*E21B 34/14* (2006.01)

(52) U.S. Cl.
CPC ..... *E21B 43/26* (2013.01); *E21B 34/14* (2013.01)

(58) Field of Classification Search
CPC ..... E21B 43/26; E21B 33/138; E21B 33/12
See application file for complete search history.

(56) References Cited

U.S. PATENT DOCUMENTS 2,933,136 A * 4/1960 Ayers ..... C09K 8/72 166/284
4,407,368 A 10/1983 Erbstoesser
4,410,387 A 10/1983 Halkerston et al.
4,505,334 A 3/1985 Doner et al.
5,253,709 A 10/1993 Kendrick et al.
5,485,882 A 1/1996 Bailey et al.
7,647,964 B2 1/2010 Akbar et al.
9,022,107 B2 * 5/2015 Agrawal ..... E21B 23/04 166/193
2009/0101334 A1 4/2009 Baser et al.
2012/0234538 A1 9/2012 Martin et al.

OTHER PUBLICATIONS

Dictionary definition of "epoxy", accessed on Apr. 5, 2016 via www.thefreedictionary.com.*
Alcobra Metals, Inc. for "aluminum", accessed on Apr. 5, 2016 via https://alcobrametals.com/guides/aluminum.*

* cited by examiner

*Primary Examiner* — Blake Michener
*Assistant Examiner* — Manuel C Portocarrero
(74) *Attorney, Agent, or Firm* — Kammer Browning PLLC

(57) ABSTRACT

A hydraulic fracturing ball sealer used in fracturing of shale formations. A preferred embodiment is constructed of a generally spherical core and a pair of hemispherical shells positioned about the core. The shells are secured to each other along an equatorial seam. The multilayer frac-ball provides a strong but machinable structure with a pliable outer surface that is corrosion resistant, has a specific gravity that allows it to float in the fracturing fluid, and is relatively easy and inexpensive to manufacture. The frac-ball of the present invention is a two piece metal and polymer design. A two-part embodiment comprises a polymer core with a metal case or shell. A layer of epoxy resin may be used to secure the shell to the core. Alternate embodiments include multiple layers of different materials, generally arranged concentrically within the spherical shape. The surface of the frac-ball may be smooth, scored, or serrated.

18 Claims, 4 Drawing Sheets

HYDRAULIC FRACTURING BALL SEALERS

CROSS REFERENCES TO RELATED APPLICATIONS

This application claims the benefit under Title 35 United States Code §119(e) of U.S. Provisional Application 61/828,239, filed May 29, 2013 the full disclosure of which is incorporated herein by reference.

BACKGROUND OF THE INVENTION

1. Field of the Invention

The present invention relates generally to systems for facilitating the extraction of natural gas deposits from underground geologic formations. The present invention relates more specifically to ball sealer devices commonly known as "frac-balls" that are generally spherical objects that are injected into a well to close off portions of the well to allow pressure to build up and cause fracturing in a target section of the geologic formation.

2. Description of the Related Art

Hydraulic fracturing, commonly referred to as "fracking", is the process of creating small cracks, or fractures, in underground geological formations to allow natural gas to flow into the wellbore and to the surface where the gas is collected and distributed. Variables such as the permeability and porosity of the surrounding rock formations and the thickness of the targeted shale formations are studied by geoscientists before the fracking process is conducted. The result is a highly sophisticated and carefully engineered process that creates a network of fractures that are contained within the boundaries of the targeted deep shale natural gas formation.

During the fracking process, a mixture of water, sand and other chemical additives designed to protect the integrity of the geological formation and enhance production is pumped under high pressure into the shale formation to create small fractures. The mixture is typically about 99.5% water and sand, along with small amounts of special-purpose additives. The newly created fractures are maintained in an open condition by the sand, which allows the natural gas to flow into the wellbore where it is collected at the surface and subsequently delivered to a wide ranging group of consumers.

One of the tools used by some operators of hydraulic fracturing equipment are specially sized "frac-balls" that are injected into a well to block or close off portions of a well to allow pressure to build up and cause the fracturing in a target section of the well. Frac-balls may be made of various materials, including G-10 (or other related phenolic plastics), Torlon® (polyamide-imide or PAI), PEEK (polyether ether ketone), and other high-temperature thermosets or thermoplastics. Typically, the material selected is based upon the operators' experience and the chemistry and temperatures within the well.

Frac-ball sizes are selected specifically to fit within the well-bore or sliding sleeves which vary in diameter as the well sections progress from upper to lower (or end) sections. One popular method for creating multiple fractures in a wellbore is the use of fracturing ports & sliding sleeves. Open hole packers isolate different sections of the horizontal well. A sliding sleeve is placed between each packer pair and is opened by injecting a properly sized frac-ball inside the borehole. Typically, a completion string is placed inside the well. The completion string includes frac ports and open hole packers spaced to specifications. The spacing between packers may be up to several hundred feet. The packers are actuated by mechanical, hydraulic or chemical mechanisms. In order to activate each sleeve, a properly sized frac-ball is pumped along with a fracturing fluid inside the well. Each ball is smaller than the opening of all of the previous sleeves, but larger than the sleeve it is intended to open. Seating of the frac-ball exerts pressure at the end of the sliding sleeve assembly, causing it to slide and open the frac ports. Once the port is opened, the fluid is diverted into the open hole space outside of the completion assembly, causing the formation to fracture.

At the completion of each fracturing stage, the next larger frac-ball is injected into the well, which opens the next sleeve, and so on, until all of the sleeves are opened and multiple fractures are created in the well. The main advantage of this completion technique is the speed of operation (by activating multiple fractures with a single completion string) which also significantly reduces cost.

SUMMARY OF THE INVENTION

The present invention provides an improved frac-ball structure used in the fracturing of shale formations. The frac-ball of the present invention is a unique two piece metal and polymer design. A first two-part structure comprises a polymer core with a metal case or shell. A second three-part structure comprises a fluid filled core surrounded by a polymer body, again enclosed within a metal case or shell. The surface of the frac-ball may be smooth, scored, or serrated. The hydraulic fracturing ball sealer structure of the present invention finds optimal use in sealing flow paths during the fracturing of shale formations. The generally spherical ball, is intended to be used alone or in combination with other similar balls, carried within a fracturing fluid, to seal off portions of a drilled well to facilitate the fracturing of formations surrounding the well.

One basic embodiment of the ball is constructed of a generally spherical core and a pair of hemispherical shells positioned about the core. The hemispherical shells are secured to each other along an equatorial seam. The multi-layer frac-ball provides a strong but machinable overall structure with a pliable outer surface that is corrosion resistant, has a specific gravity that allows it (and the material it is made from) to float on the fracturing fluid, and is relatively easy and inexpensive to manufacture. A layer of epoxy resin may be used to help secure the shell to the core. Further alternate embodiments may include multiple layers of differ materials, generally arranged concentrically within the spherical shape. The surface of the frac-ball may be smooth, scored, or serrated.

DETAILED DESCRIPTION OF THE PREFERRED EMBODIMENTS

Figure 1:
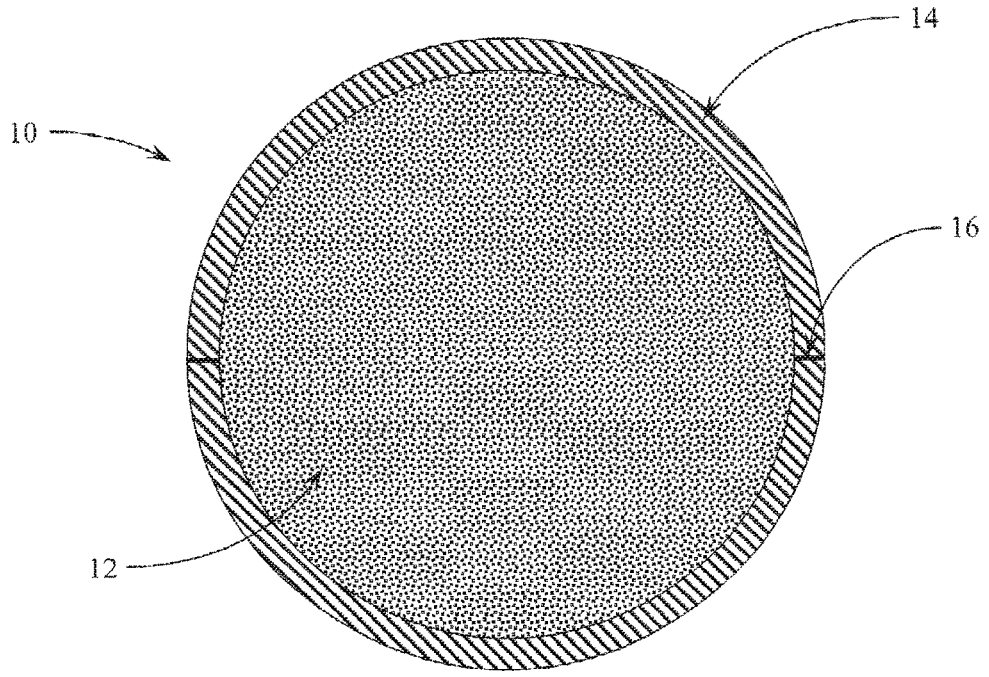
FIG. 1 is a cross-sectional view of the internal structure of a first preferred embodiment of the frac-ball device of the present invention.
Figure 2:
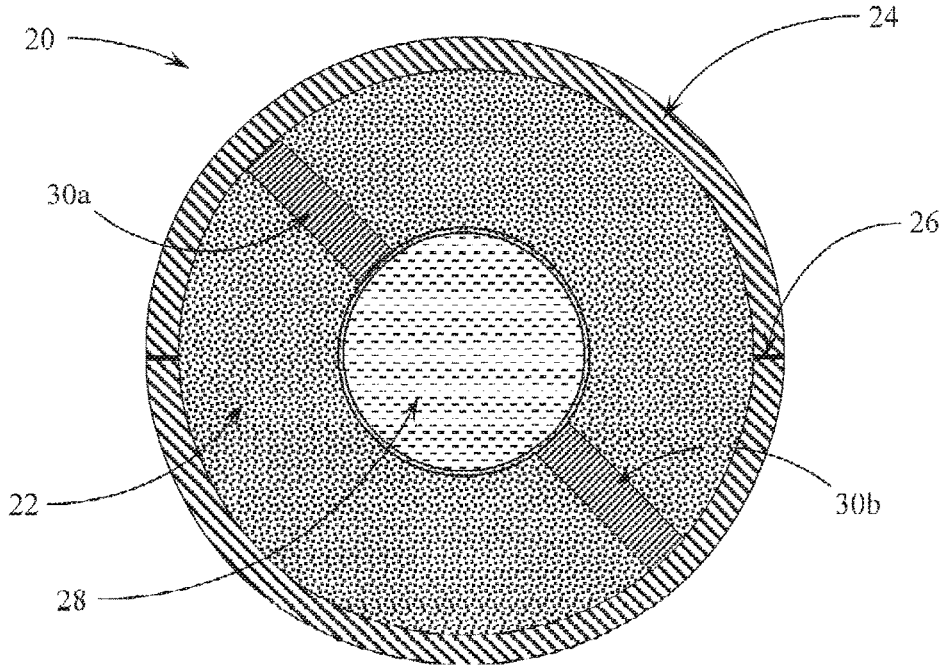
FIG. 2 is a cross-sectional view of the internal structure of a second preferred embodiment of the frac-ball device of the present invention.

The present invention provides an improved frac-ball structure used in the fracturing of shale formations. The frac-ball structures are generally described as two piece metal and polymer designs. A first, two-part structure (see FIG. 1) comprises a polymer core 12 with a metal case or shell 14. A second, three-part structure (see FIG. 2) comprises a fluid filled core 28 surrounded by a polymer body 22, again enclosed within a metal case or shell 24. With either internal design the surface of the frac-ball may be smooth (see FIG. 5A), scored, or serrated (see FIG. 5B).

The frac-ball inner design (FIGS. 1 & 2) primarily consists of a polymer stock material shape resin and/or mixture, and/or epoxy, epoxy glass or glass fibers, epoxy glass and/or fiber laminates, carbon fibers and/or windings, Kevlar® fibers and/or windings adhered to and/or bonded with an epoxy or polymer. All of the base materials may be various durometers and physical properties.

The second preferred embodiment (FIG. 2) of the present invention additionally comprises a fluid filled core 28 of cured or un-cured hydraulic based cement materials. The core may preferably consist of a variety of liquids, epoxies, water, synthetic and/or organic based oils.

The inner core 28 is suspended with offsets 30*a* & 30*b* by means of machined, inserted, bonded or otherwise incorporated onto the core from the base materials. The core centering offsets 30*a* & 30*b* may also be incorporated on the outer shell 24 in any of the listed base materials. The offsets 30*a* & 30*b* themselves may preferably comprise individual components of any of the listed base materials and or metals listed for the outer shell and the inner core.

The outer case/cover/shell (14 in FIG. 1, and 24 in FIG. 2) is preferably made by a machining process from solid rod, forging, stamping, deep drawing, casting or spray bonding. The cover may preferably be manufactured from one or any of the following metallic materials of various grades: aluminums, steels, stainless steels, Inconel®, titanium, and additional specialty blended steel and aluminum alloys. The design of the outer case/cover/shell is not restricted to the initial spherical shape and may be manufactured with or without outer serrations or additional external features (see FIG. 5B). The outer shell is (under appropriate manufacturing embodiments) joined either by welding, bonding, spin welding, forged, pressed, stamped or mechanically fastened as generally referenced (16 in FIG. 1, and 26 in FIG. 2).

The overall design of the frac-balls of the present invention is capable of performing in a variety of uses in the process of shale fracturing operations. Any of the listed combinations of designs will be capable of operating at pressures of 500 psi-25,000 psi. The described designs may be preferably sized from 1" diameter incrementally up to 10" in diameter (see represented generally in FIG. 5C), with various inner core sizes. The case/cover/shell may preferably be manufactured in a variety of wall thicknesses.

Figure 3A:
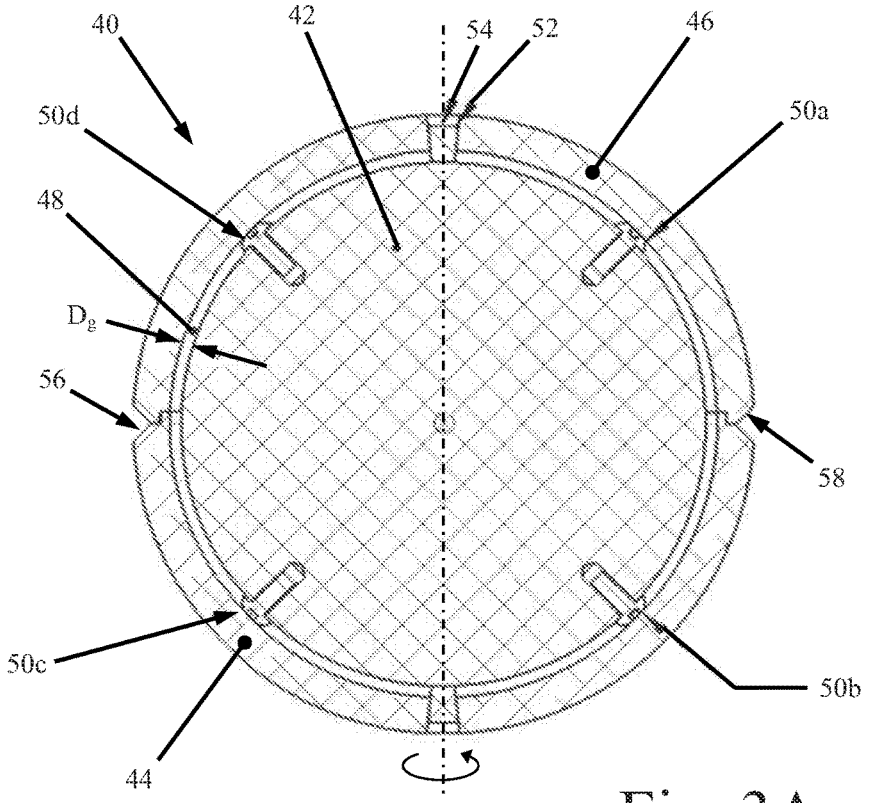
FIG. 3A is a detailed cross-sectional view of the internal structure of a third preferred embodiment of the frac-ball device of the present invention.
Figure 3B:
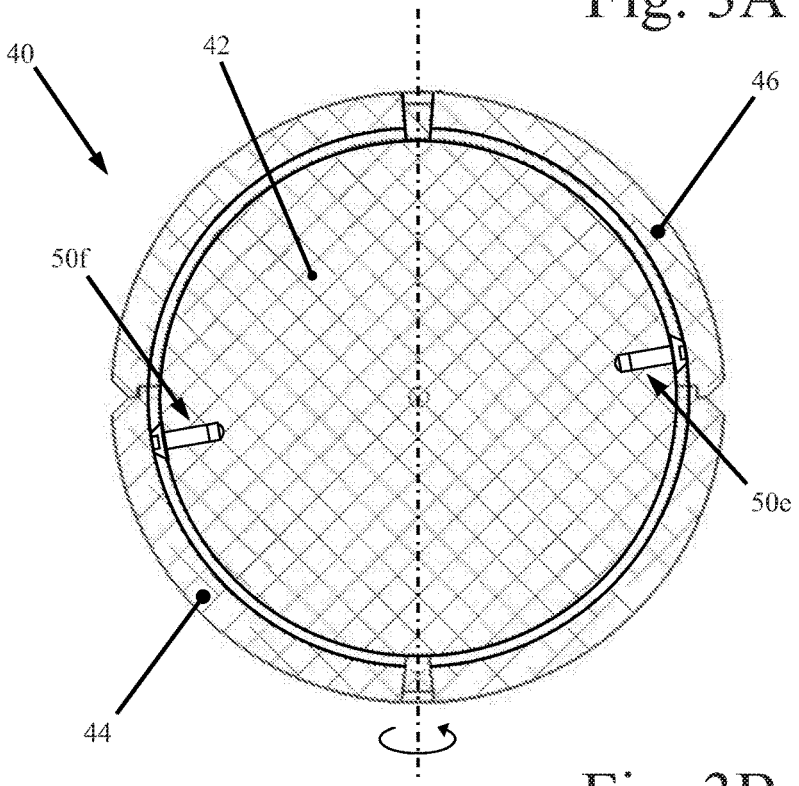
FIG. 3B is a detailed cross-sectional view of the internal structure of the third preferred embodiment of the frac-ball device of the present invention shown in FIG. 3A and rotated ninety degrees on the axis shown.
Figure 4A:
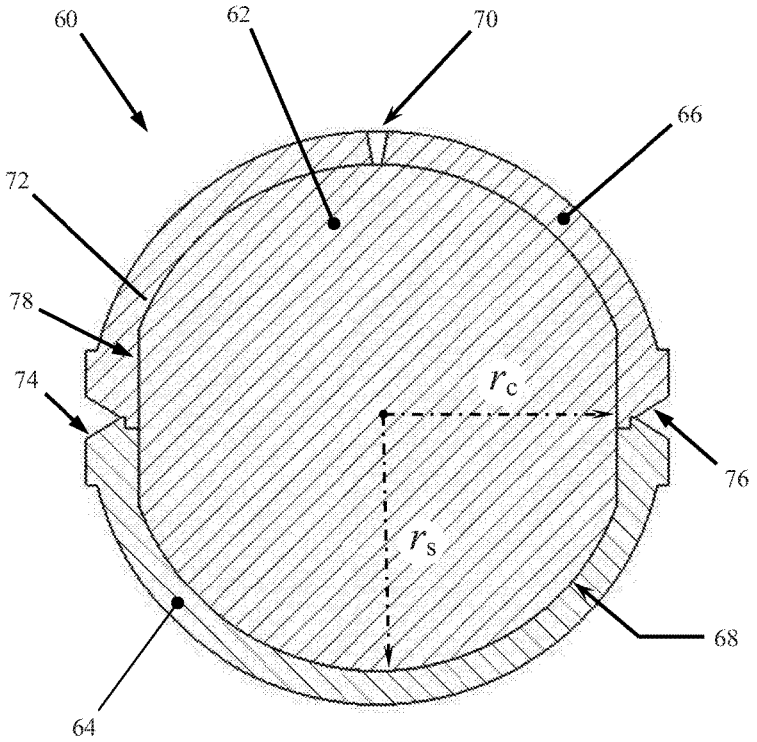
FIG. 4A is a detailed cross-sectional view of the internal structure of a fourth preferred embodiment of the frac-ball device of the present invention.

Reference is next made to FIGS. 3A & 3B as well as FIG. 4A which are cross-sectional views of alternate preferred embodiments of the present invention. Reference to these embodiments includes additional specific details regarding preferred manufacturing processes for the multilayer configurations. The typical ball manufactured according to the present invention uses a shell thickness of 0.1875"-0.200" regardless of the overall ball diameter. However, maintaining a consistent ratio or percentage between shell thickness and ball diameter is preferable as ball diameter grows. The added thickness will help overcome the increased force acting on the ball as its projected area increases. In the examples described herein, the shell thickness is preferably on the order of 8.3% of ball diameter. The outer shell, inside diameter is preferably slightly larger than the inner core, outside diameter. In the example described herein, the clearance between the inner core and the outer shell is typically between 0.0005"-0.0015". In general, the shell (or shell halves) and core should fit as tightly as possible.

Figure 4B:
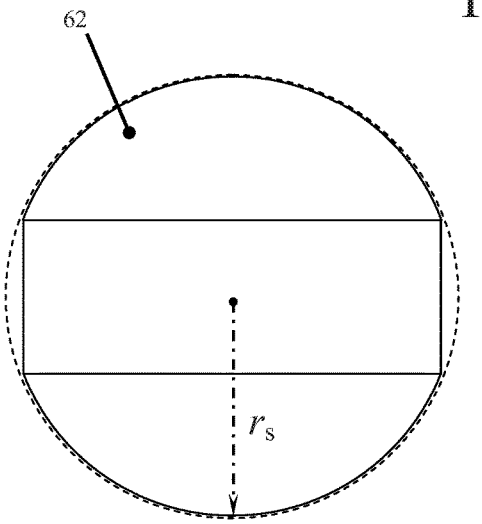
FIGS. 4B & 4C are elevational and top views respectively of the core of the fourth preferred embodiment of the frac-ball device of the present invention shown in FIG. 4A.
Figure 4C:
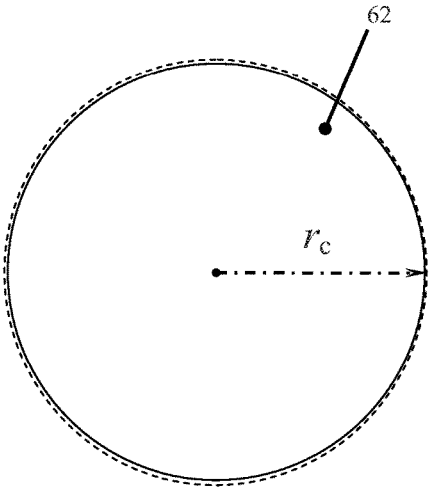

In the example shown in FIGS. 4A-4C, the G-10 core is cylindrical. This allows more aluminum alloy in the area being welded. This also helps disperse heat during welding and adds additional strength in the seam area when under stress.

The basic fracturing ball constructed according to the present invention is a single core, two layer design. However, the present invention anticipates ball construction comprising several cores and layers. These cores and layers can be made from, but are not limited to, plastics, rubbers, glass fibers, carbon fibers, zinc alloys, and aluminum alloys. Using dissimilar materials for construction facilitates the creation of a ball with ideal fracturing properties for a given borehole drilling environment. The target properties that make a fracturing ball function optimally are: (a) strong/resilient (able to withstand high pressures); (b) pliable (for sealing against the ball seat); (c) easily machinable (for removal from the pipe); (d) corrosion resistant; and (e) a specific gravity higher than the frac ball carrier or fracturing fluid (to insure that the ball and any ball debris will float). Additionally, the core and the layers should adhere well to one another to minimize the possibility that the ball may distort and fail when under stress.

The basic multilayer designs of the frac-ball 40 of the present invention (according to the embodiment shown in FIGS. 3A & 3B are preferably made up of a G-10 (or other related phenolic plastics) core 42, a two-part epoxy inner layer 48, and a 6013-T8 aluminum (or similar) outer layer/shell (made up of hemispherical shell halves 44 & 46 in the embodiment shown in FIGS. 3A & 3B). The basic design contains a spherical G-10 core 42, but a partially cylindrical core 62, as in the two-piece design shown in FIGS. 4A-4C may be preferable because of manufacturing efficiencies (discussed in more detail below).

With all multilayer balls, it is important to keep the inner core 42 and outer layers 44 & 46 centered during the manufacturing process. To facilitate this, rigid standoffs 50*a*-50*f* are positioned to create a space $D_g$ between the core and the outer shell. These standoffs 50*a*-50*f* hold the core 42 in place as the interlayer epoxy 48 cures. A preferred minimum of six standoffs 50*a*-50*f* (orthogonally oriented) are inserted into the core 42 to take up the inner layer's cross section. These are preferably fixed (screwed down) using aluminum 4-40 button head screws. These standoffs 50*a*-50*f* are preferably located on the core top, bottom, left, right, front, and back (orthogonally oriented and angularly spaced). When fully inserted, the protruding head of the screw provides the required standoff. The head height that protrudes is approximately 0.062". Alternately, dowel pins (similar to the structures shown in FIG. 2) may be used, although it is important that they are positioned/inserted such that they are equally proud to one another. Ideally, whatever is used to center the core should be as small as possible so as to not interfere with the overall design intent related to strength, pliability, and specific gravity.

After the standoffs 50*a*-50*f* are installed, the core 42 may be placed inside the shells 44 & 46 in most any random orientation. However, it is preferable that none of the standoffs 50*a*-50*f* end up being located on the shell seam 56 & 58, as a weak area or void can develop during welding as a result. The epoxy material 48 is then injected through at least one 0.125" tapered vent hole 52 located at the one or both of the shell's poles. The vent 52 provides both a place to inject the epoxy material 48 and additionally allows welding gasses to escape. Fracturing balls may be manufactured with either one or two vent holes, although in any case it is preferable to position these at the pole(s).

After the epoxy cures, the two hemispheres 44 & 46 can be carefully welded together (MIG welding as is typical for the preferred type of aluminum). The epoxy material 48 may actually be injected either before or after welding with similar results. Ideally, there should be full weld penetration, even though this may be difficult to achieve without affecting the epoxy and/or the G-10 as they do not typically hold up to welding temperatures.

Examples of materials that meet the requirements of the manufacturing process described above include, but are not limited to, the following:

Core 42—G-10 Glass Based Phenolic. This type of glass-epoxy laminate material is specified for its extremely high strength and high dimensional stability over temperature. G-10 is often used for terminal boards, high humidity applications, electrical and electronic test equipment and electric rotor insulation. While the material is strong it may still be considered machinable under the conditions encountered within the present invention.

Epoxy 48—West Systems, G/flex Two Part Epoxy. A toughened, versatile, liquid epoxy typically used for permanent waterproof bonding of fiberglass, ceramics, metals, plastics, damp and difficult-to-bond woods. With a modulus of elasticity of 150,000 PSI, it is generally more flexible than standard epoxies and polyesters, but much stiffer than adhesive sealants. This type of epoxy provides structural bonds that can absorb the stress of expansion, contraction, shock and vibration, and make it ideal for bonding dissimilar materials.

Standoffs 50*a*-50*f*—304 Stainless Steel (SS) or Aluminum 4-40 Button Head Screws (BHS) ⅜ Long. These provide sufficient penetration into the core 42 for stability and offer a head thickness that creates an appropriate spacing to center the core 42 within the hemispherical shells 44 & 46 and allow for the injection of the epoxy 48. While other standoff devices may be used, these BHSs provide a consistent spacing without the need to accurately control profile height during the manufacturing process.

Shell Hemispheres 44 & 46—Alcoa Excalibar® 6013-T8 Aluminum Round. Provides high strength and good corrosion resistance. This material is easily joined by most welding and brazing methods. The material has excellent compressive properties, good applied coating acceptance, and good machinability.

Welding Rod (not shown)—Preferably 4043, 4047, or 4643. (5xxx series welding rods should not generally be used on 6013 aluminum.) 4043 is (for example) designed specifically for welding 6xxx series aluminum alloys. It has a lower melting point and more fluidity than the xxx series filler alloys, and is less sensitive to weld cracking with the 6xxx series base alloys. 4043 and similar generally give more weld penetration but may produce welds with less ductility. These welding rods (4043, 4047, and 4643) are also better suited to higher service temperatures exceeding 150° F.

In the manufacturing process it is preferable to prepare the inside of the shells 44 & 46 and the outside of the G-10 core 42 using 80/60 grit emery cloth or similar. All of the parts are assembled as shown in FIGS. 3A & 3B, again noting that the standoffs 50*a*-50*f* should not be positioned on the shell equator/seams 56 & 58 or on a tapered vent 52. The seams should be MIG welded with full penetration, taking care not to overheat G-10 core material 42 adjacent the seams 56 & 58. The epoxy 48 is injected into the tapered vent hole 52 until all air is expelled and epoxy comes out the lower vent. This will help assure that the ball inner layer is full of epoxy. After the epoxy 48 has cured, a 5/16" hole is drilled (⅛" deep) in the vent location(s) 52 with care taken to remove all loose debris. The plug 54 (preferably made of the same material as the shells 44 & 46) is pressed into the drilled hole 52 to 1/16" below the surface of the ball 40 and is TIG welded in place. The entire outer surface of the ball 40 is then machine finished and polished.

The alternate embodiment shown in FIGS. 4A-4C eliminates the epoxy layer and therefore the need for standoffs in the manufacturing process. In this embodiment, frac-ball 60 is generally made up of partially cylindrical/spherical core 62 surrounded by hemispherical shells 64 & 66. The dimensions of the core 62 and the shells 64 & 66 are such as to provide a tight interface 68 between the layers. Spherical radius $r_s$ as indicated in FIGS. 4A & 4B, is generally larger than cylindrical radius $r_c$ of the cylindrical midsection of core 62 indicated in FIGS. 4A & 4C. A vent hole 70 is provided as shown but strictly for the purpose of venting welding gases during the manufacturing process. A plug (not shown) is secured in vent hole 70 after welding along seams 74 & 76 has been completed.

Use of a partially cylindrical spherical core 62 as shown in FIGS. 4A-4C allows more aluminum alloy in the area 78 being welded which results in better heat dispersion during welding and adds strength to the seam area when the ball is in use under stress. The assembly process for the two piece ball embodiment, such as is shown in FIG. 4A, is the same but without the standoffs and epoxy. At least one vent is still required to expel welding gases as described above. It may be beneficial to spray a thin layer of thermal insulating material between the layers (between the core 62 and the shells 64 & 66) to help prevent incidental damage to the core during the welding process.

Figure 5A:
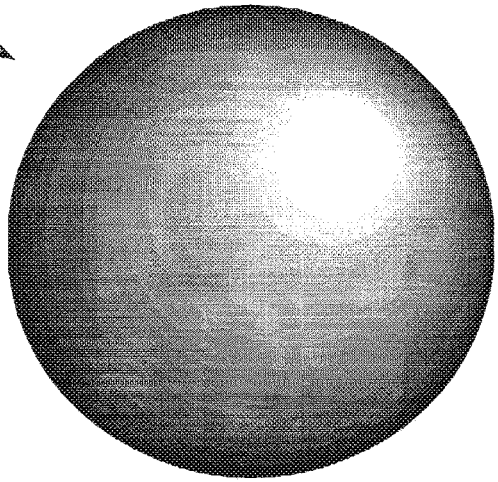
FIGS. 5A & 5B are perspective views of two variations of the outer casing or shell of the frac-ball devices of the present invention.
Figure 5B:
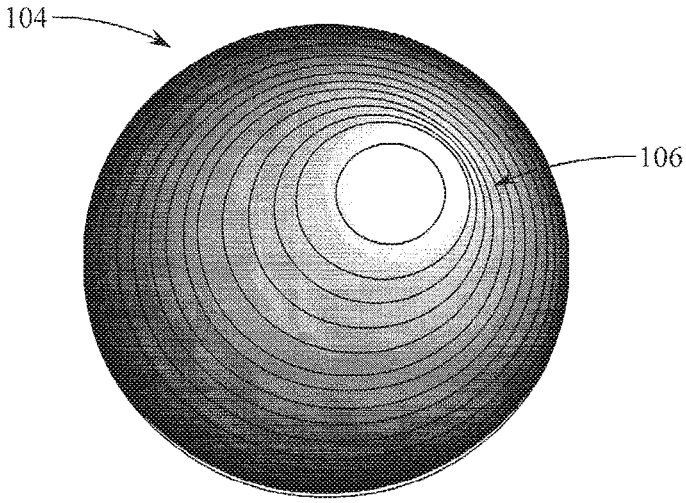
Figure 5C:
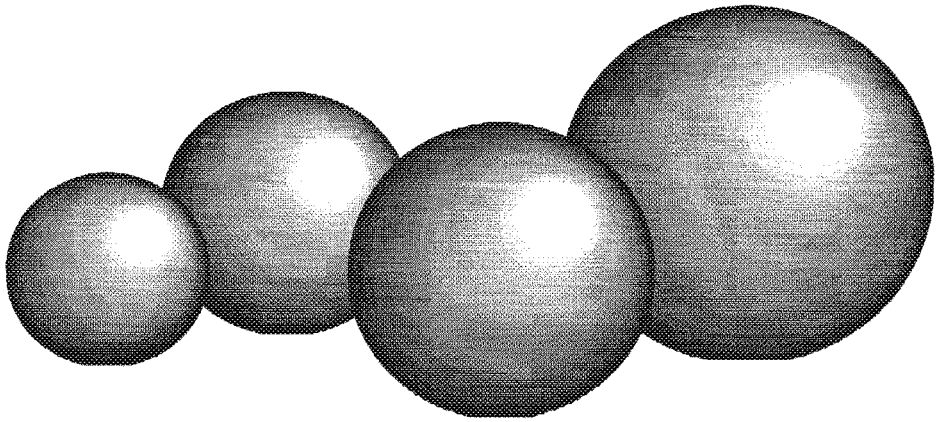
FIG. 5C is a perspective view of a number of frac-balls of the present invention of varying sizes.

FIGS. 5A & 5B are perspective views of two variations of the outer casing or shell of the frac-ball devices of the present invention. FIG. 5A provides frac-ball 102 with a smooth outer casing while FIG. 5B provides frac-ball 104 with an outer casing having a serrated outer surface 106. FIG. 5C is a perspective view of a number of frac-balls of the present invention of varying sizes.

Although the present invention has been described in conjunction with a number of preferred embodiments, those skilled in the art will recognize modifications to these embodiments that still fall within the scope of the present invention. While the basic structure of the frac-ball of the present invention is characterized by the preferred embodiments described above, various environments within which the frac-ball may be used may dictate variations in the material compositions of the various components in the multi-layer ball. In addition, variations in the size of the overall ball may dictate the selection of one of the specific internal structures described and defined in the above disclose to either improve the specific performance of the ball or to balance the geometry of the environmental requirements (the size of the ball) with its durability. The basic multilayer structure provide a means by which all of the desirable characteristics of a frac-ball may be optimized for a particular fracturing operation.

We claim:

1. A generally spherical frac-ball used alone or in combination with other similar balls carried within a fracturing fluid to seal off portions of a drilled well to facilitate the fracturing of formations surrounding the well, the generally spherical frac-ball comprising:

a generally spherical core having a core diameter and a surface;

a pair of hemispherical shells positioned concentrically about the core and secured to each other along an equatorial seam, the pair of hemispherical shells combining to form a generally spherical shell having an internal diameter, a frac-ball diameter, and a shell thickness, the internal diameter of the spherical shell incrementally larger than the core diameter;

a layer of epoxy resin positioned between the core and the shell; and a plurality of standoffs positioned on the core surface, the plurality of standoffs having a height generally equal the incremental difference between the core diameter and the internal diameter of the spherical shell, wherein when the pair of hemispherical shells are positioned around the core the spherical shell and the core are generally concentric;

wherein the frac-ball construction provides a strong but machinable overall structure with an outer surface that is corrosion resistant, has a specific gravity that is higher than the fracturing fluid, and is easy to manufacture.

2. The frac-ball of claim 1 wherein the pair of hemispherical shells each comprise a machinable and weldable metal material.

3. The frac-ball of claim 2 further comprising a weld securing the pair of hemispherical shells together along the equatorial seam.

4. The frac-ball of claim 1 wherein the shell thickness is in the range of 8.0-8.5 percent of the frac ball diameter.

5. The frac-ball of claim 1 wherein at least one of the pair of hemispherical shells has a vent hole positioned through the shell thickness at a position apart from the equatorial seam, the vent hole serving as a port for releasing gases from between the core and the spherical shell during manufacture and as an injection port for the epoxy resin.

6. The frac-ball of claim 1 wherein the plurality of standoffs comprises six standoffs positioned orthogonally of the core surface, the six standoffs each comprising a threaded screw with a screw head, each threaded screw inserted into the core with the screw head providing the standoff height.

7. The frac-ball of claim 1 wherein the generally spherical core comprises a polymer plastic material.

8. The frac-ball of claim 7 wherein the polymer plastic material comprises a phenolic laminate material.

9. A generally spherical frac-ball used alone or in combination with other similar balls carried within a fracturing fluid to seal off portions of a drilled well to facilitate the fracturing of formations surrounding the well, the generally spherical frac-ball comprising:

a rounded cylindrical core, the core comprising:

a cylindrical midsection having a center axis, a cylindrical height and a cylindrical radius;

a semispherical top portion centered on the cylindrical midsection and having a spherical radius greater than the cylindrical radius; and a semispherical bottom portion centered on the cylindrical midsection opposite from the semispherical top portion and having a spherical radius approximately equal to the spherical radius of the semispherical top portion;

a pair of generally hemispherical shells positioned concentrically about the core and secured to each other along an equatorial seam, the pair of generally hemispherical shells combining to form a generally spherical shell having an interior shaped and sized to tightly receive the rounded cylindrical core, the generally spherical shell having a predominant shell thickness and a frac-ball diameter;

wherein the frac-ball construction provides a strong but machinable overall structure with an outer surface that is corrosion resistant, has a specific gravity that is higher than the fracturing fluid, and is easy to manufacture.

10. The frac-ball of claim 9 wherein the generally spherical core comprises a phenolic plastic material.

11. The frac-ball of claim 9 wherein the pair of generally hemispherical shells each comprise a machinable and weldable metal material.

12. The frac-ball of claim 11 further comprising a weld securing the pair of generally hemispherical shells together along the equatorial seam.

13. The frac-ball of claim 12 wherein the pair of generally hemispherical shells each comprise a cylindrical welding band portion forming an edge of the shell comprising the equatorial seam, the welding band portion comprising an increased shell thickness and an angled edge forming a weld channel with the opposing generally hemispherical shell.

14. The frac-ball of claim 13 wherein the welding band portion of one of the pair of generally hemispherical shells comprises an edge ridge and the welding band portion of the other of the pair of generally hemispherical shells comprises an edge channel, the edge ridge inserting into the edge channel to form a weld wall on the equatorial seam, the weld wall separating the weld channel from the core of the frac-ball.

15. The frac-ball of claim 11 wherein at least one of the pair of hemispherical shells has a vent hole positioned through the predominant shell thickness at a position apart from the equatorial seam, the vent hole serving as a port for releasing gases from between the core and the spherical shell during manufacture.

16. The frac-ball of claim 9 wherein the predominant shell thickness is in the range of 8.0-8.5 percent of the frac-ball diameter.

17. The frac-ball of claim 9 wherein the frac-ball diameter is in the range of one inch to ten inches.

18. The frac-ball of claim 9 wherein the pair of generally hemispherical shells each further comprise a serrated outer surface.

* * * * *